US005570074A

United States Patent [19]

Steigerwald et al.

[11] Patent Number: 5,570,074

[45] Date of Patent: Oct. 29, 1996

[54] VERY LOW LEAKAGE INDUCTANCE, SINGLE-LAMINATE TRANSFORMER

[75] Inventors: Robert L. Steigerwald, Burnt Hills; Alexander J. Yerman, Scotia; Waseem A. Roshen, Clifton Park, all of N.Y.

[73] Assignee: General Electric Company, Schenectady, N.Y.

[21] Appl. No.: 453,229

[22] Filed: May 30, 1995

[51] Int. Cl.[6] ..... H01F 27/30

[52] U.S. Cl. ..... 336/83; 336/183; 336/200; 336/223; 336/232

[58] Field of Search ..... 336/83, 186, 180, 336/182, 183, 200, 223, 232

[56] References Cited

U.S. PATENT DOCUMENTS 4,755,783 7/1988 Fleischer et al. ..... 336/223

*Primary Examiner*—Thomas J. Kozma

*Attorney, Agent, or Firm*—Jill M. Breedlove; Marvin Snyder

[57] ABSTRACT

A transformer having a very low, predetermined leakage inductance includes an elongate dielectric laminate having two surfaces. A primary winding having a pattern conformal to the configuration of the laminate is disposed on one surface and extends substantially the length of the laminate. The laminate has at least one secondary winding disposed on its other surface. The laminate is rolled with a dielectric layer about a cylinder, and the primary and secondary windings are patterned such that the primary and secondary windings comprise interleaved winding layers with the dielectric layer disposed between each of the winding layers. The rolled laminate, dielectric layer, and windings are contained within a cylindrical magnetic pot core. The result is a transformer having tightly interleaved primary and secondary windings and, therefore, a very low leakage inductance. In addition, the distance between adjacent primary and secondary turns is fixed by the thickness of the dielectric layer; hence, the leakage inductance is highly predictable.

8 Claims, 4 Drawing Sheets

VERY LOW LEAKAGE INDUCTANCE, SINGLE-LAMINATE TRANSFORMER

FIELD OF THE INVENTION

The present invention relates generally to magnetic circuit components and, more particularly, to transformers made from flexible dielectric laminates and conductive films.

BACKGROUND OF THE INVENTION

A transformer having a very low, predetermined leakage inductance is desirable for many power supply applications, such as, for example, synchronous rectifiers and radar power supplies. Low-profile magnetic devices can be constructed with "z-fold" magnetics; that is, the fabrication of magnetic devices using a pattern of conductive traces on flexible substrates which are z-folded (like an accordion) and inserted into a magnetic core, typically with a core post. An exemplary z-fold magnetic device is described in U.S. Pat. No. 5,126,715 of A. J. Yerman and W. A. Roshen, issued Jun. 30, 1992, assigned to the instant assignee, and incorporated by reference herein. The transformer of U.S. Pat. No. 5,126,715 includes a continuous, serpentine primary winding that is configured and z-folded to form a multi-pole, multi-layer winding having separate secondary winding layers interleaved with the primary winding. Other z-fold devices are described in U.S. Pat. Nos.: 4,943,793; 4,959,630; 5,017,902; 5,084,958; 5,134,770; 5,126,715; and 5,291,173; all of which are assigned to the instant assignee and incorporated by reference herein.

Although z-fold magnetics have resulted in much lower profile devices, such devices typically require at least two separate dielectric substrates with conductive film windings comprising the primary and secondary windings patterned thereon. Unfortunately, the distance between primary and secondary windings in such z-fold configurations is difficult to precisely determine and control, resulting in higher than desired leakage inductance values and/or tolerances.

Another type of magnetic device using dielectric substrates with conductive film windings patterned thereon is a barrel-wound type. Such windings are wound about a mandrel and inserted into a magnetic cup core with a cylindrical core post. Barrel-wound devices employing two separate dielectric substrates with conductive film windings share the same problems of higher and difficult to control leakage inductance as z-fold devices do. Another type of barrel-wound transformer uses a single dielectric substrate with primary and secondary windings patterned adjacent to each other, as described in Yerman U.S. Pat. No. 5,206,621, issued Apr. 27, 1993 and assigned to the instant assignee, which is incorporated by reference herein Although the conductive windings of the types described hereinabove are fairly well interleaved, it is desirable to configure flexible conductive film windings to achieve a higher degree of interleaving and a low, controlled value of leakage inductance.

SUMMARY OF THE INVENTION

A transformer having a very low, predetermined leakage inductance comprises an elongate dielectric laminate having two surfaces. A primary winding having a pattern conformal to the configuration of the laminate is disposed on one surface and extends substantially the length of the laminate. The laminate has at least one secondary winding disposed on its other surface. The laminate is divided into corresponding sections on its two surfaces, each section having a length corresponding to the length of a winding turn. The secondary winding comprises at least two patterned conductive films spatially separated on the laminate, each of the secondary winding conductive films occupying substantially the length of one section.

The laminate is rolled with a dielectric layer about a cylinder (e.g., either a bobbin or an actual core post of a cylindrical pot core), and the primary and secondary windings are patterned such that the primary and secondary windings comprise interleaved winding layers with the dielectric layer disposed between each of the winding layers. The rolled laminate, dielectric layer, and windings are contained within a cylindrical magnetic pot core. The result is a transformer having tightly interleaved primary and secondary windings and, therefore, a very low leakage inductance. In addition, the distance between adjacent primary and secondary turns is fixed by the thickness of the dielectric layer; hence, the leakage inductance is highly predictable.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1A:
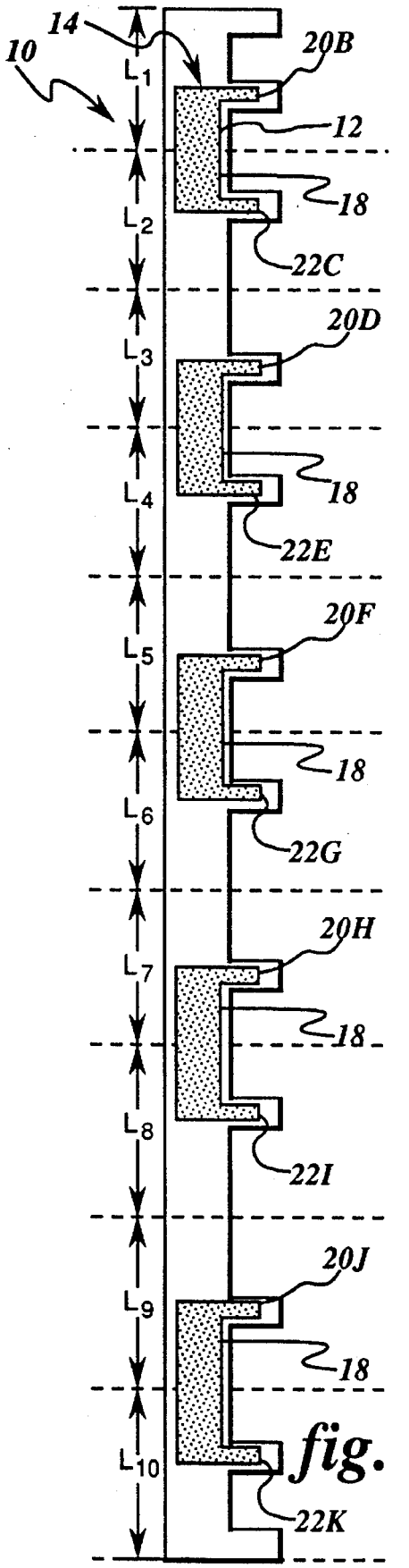
FIG. 1A illustrates one surface of a dielectric substrate with a secondary winding patterned thereon according to the present invention.
Figure 1B:
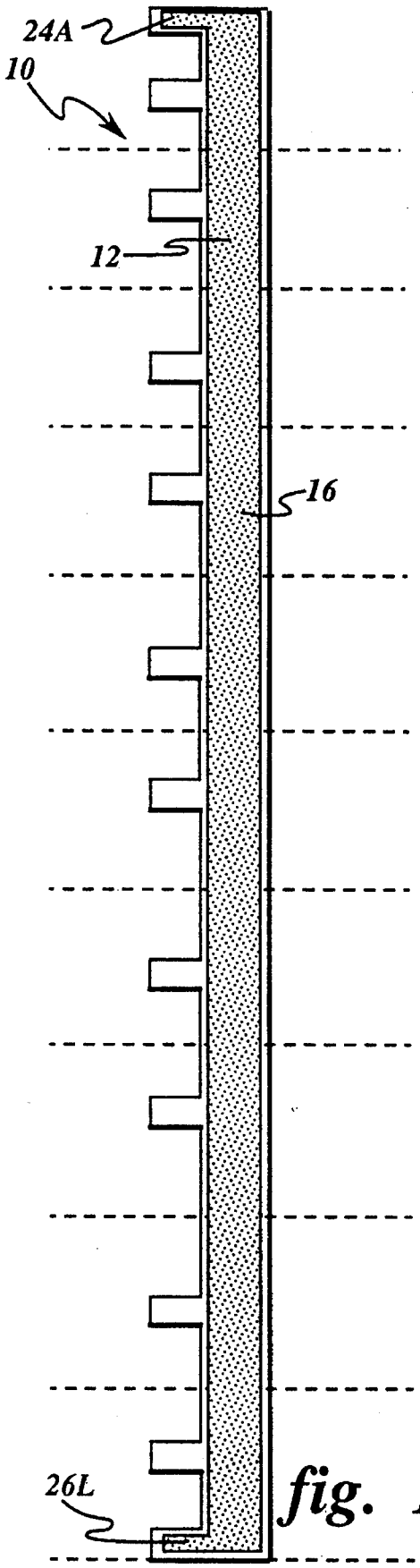
FIG. 1B illustrates the other surface of the dielectric substrate of FIG. 1A with a primary winding patterned thereon according to the present invention.

FIG. 1A and FIG. 1B illustrate opposite surfaces of a laminate 10 comprising a dielectric substrate 12 with a secondary conductive film winding 14 on the surface illustrated by FIG. 1A and a primary conductive film winding 16 on the surface illustrated by FIG. 1B. Secondary conductive film winding 14 is shown, by way of example only, as comprising five separate patterned conductive films 18, each having terminations 20 (B, D, F, H and J) and 22 (C, E, G, I and K). Primary conductive film winding 16 is shown, also by way of example only, as comprising a single continuous rectangular conductive film with terminations 24A and 26L. The alphabetical notations A–L attached to the termination reference numbers 20, 22, 24 and 26 are useful in understanding the configuration of the windings of FIGS. 1A and 1B after barrel-winding, as described hereinafter and shown in FIG. 2.

Figure 2A:
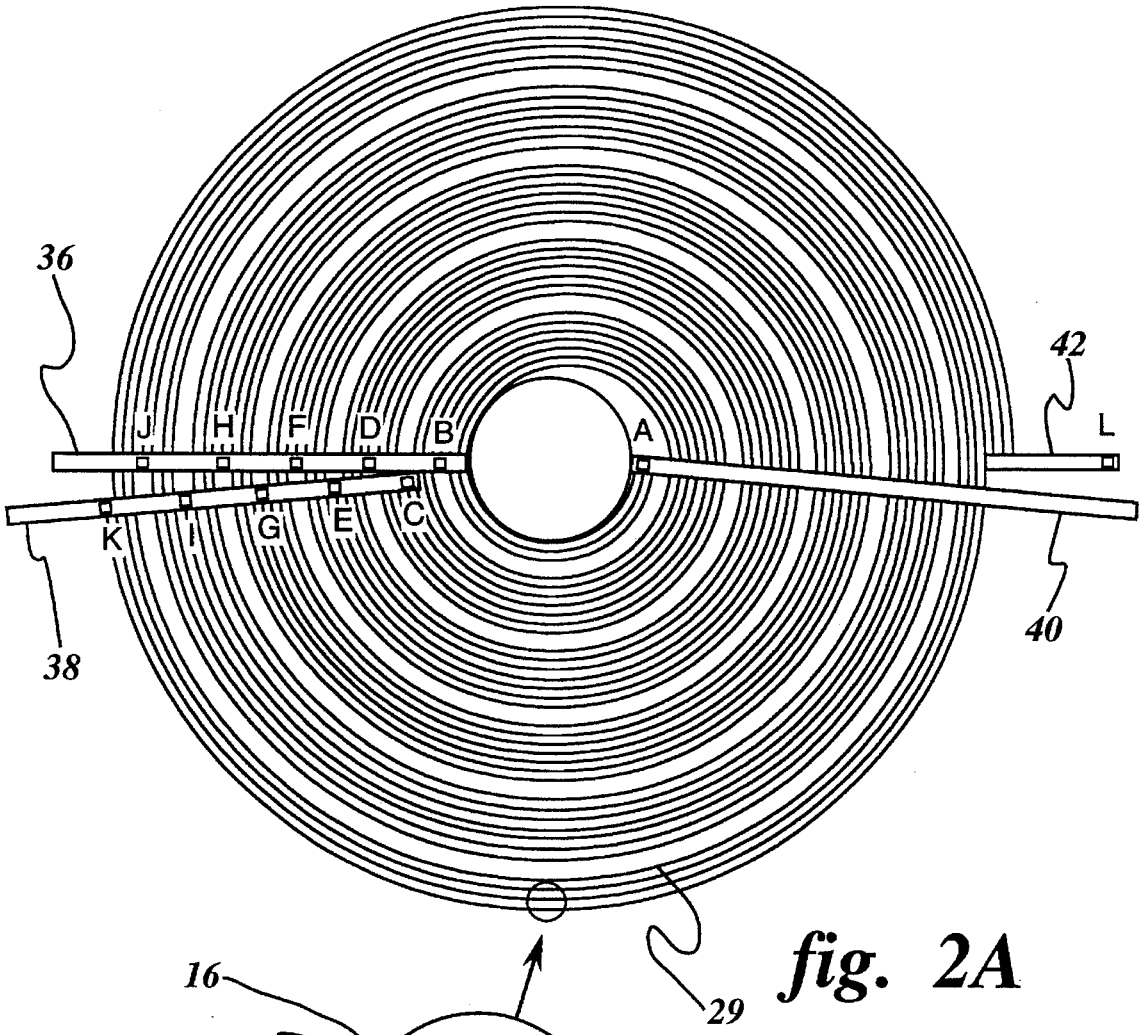
FIGS. 2A and 2B is a top view illustrating the windings of FIGS. 1A and 1B in a barrel-wound configuration.
Figure 2B:
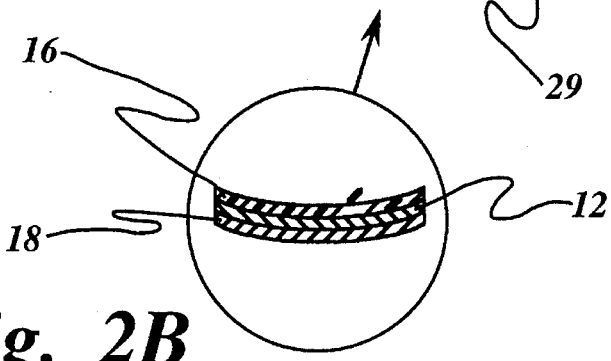
Figure 3:
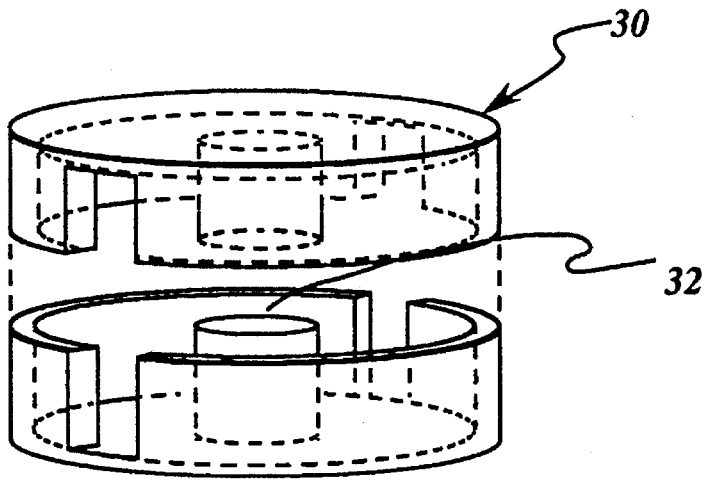
FIG. 3 is a perspective view of a pot core suitable for containing barrel-wound transformer windings according to the present invention.
Figure 5:
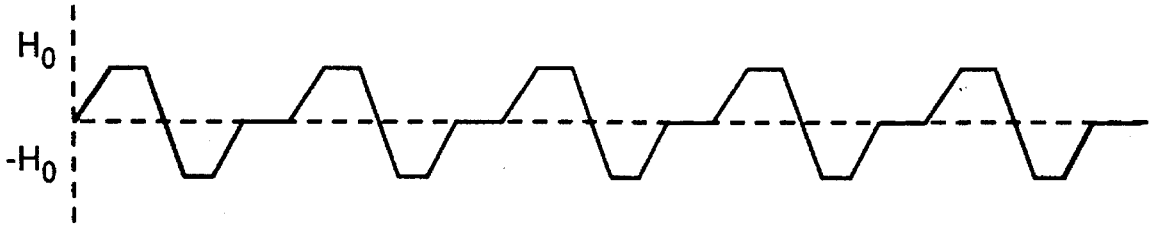
FIG. 5 graphically illustrates the magnetic field in interleaved windings of the present invention, such as those in a transformer having windings such as those of FIGS. 1A and 1B or FIGS. 4A and 4B.

During assembly of an exemplary barrel-wound transformer having windings such as those represented by FIGS. 1A and 1B, all five conductive films 18 of secondary winding 14 are connected in parallel (by connecting all terminations 20 together and all terminations 22 together) to yield a single secondary turn. The single continuous conductive film of primary winding 16 yields ten turns, as indicated in FIG. 1B. Laminate 10 is rolled with a separate dielectric layer (element 29 in FIG. 2) about a cylinder, resulting in a highly interleaved winding structure with the dielectric layer 29 insulating winding layers from each other. Specifically, by way of example only, rolling laminate 10 of FIGS. 1A and 1B with a dielectric layer 29 results in the winding structure of FIG. 2 with a 10:1 turns ratio. The resulting barrel-wound winding structure of FIG. 2 is then inserted into a magnetic core such as pot core 30 of FIG. 3 with a center post 32. The pot core 30 has openings, or windows, 33 for the winding terminations.

In order to barrel-wind laminate 10, the laminate may be rolled directly about core post 32 of pot core 30; or, alternatively, it may be rolled about a bobbin and then inserted over the core post and into the core. Since the length of the laminate depends on the radius of the winding configuration, the length of each section increases in proportion to the radius of the winding configuration. Hence, with each turn, the winding radius increases by the thickness of a turn (i.e., the laminate 10 plus the dielectric 29). Therefore, the length $L_n$ of each turn n increases with n and is approximated by the following expression:

$$L_n=2\pi[r_0+[n-1]t]$$

where $r_0$ represents the radius of the core post or bobbin around which the windings are barrel-wound, and t represents the thickness of the laminate.

As illustrated in FIGS. 1A and 1B, the primary and secondary winding terminations are offset from each other on the laminate by one-half turn in order that the primary and secondary connections extend outward from opposite sides of the same end of the transformer after barrel-winding, as illustrated in FIG. 2. Metal (e.g., copper) strips 36 and 38 are used for connecting the individual secondary conductive films 14 in parallel and for providing external connections. Metal strips 40 and 42 are used for making connections to the primary winding terminations 24A and 26L.

The rolled, i.e., barrel-wound, windings of the present invention provide a highly interleaved structure. In the specific 10:1 structure of FIG. 1, each secondary winding layer has two primary winding layers on either side thereof, and the space between windings is very small. Therefore, the leakage inductance, which depends on the square of the magnetic field, is very low. Additionally, the distance between adjacent primary and secondary winding layers is fixed by the thickness of the insulator; and, since the insulator plus any adhesive is typically quite thin, leakage inductance is further reduced.

Figure 4A:
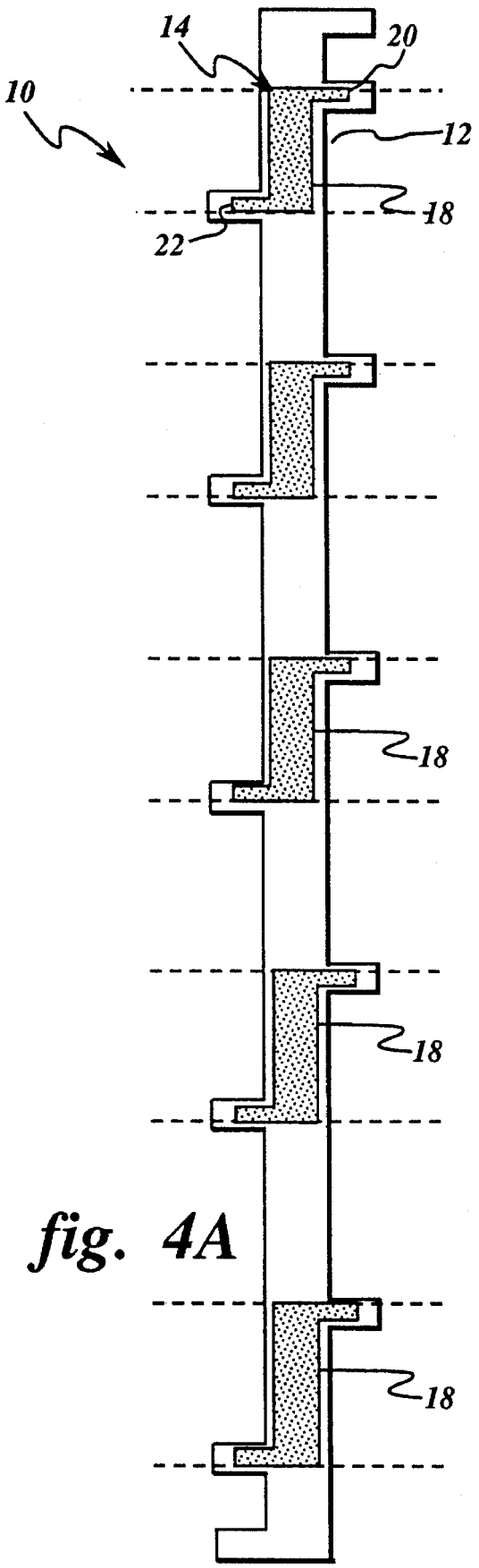
FIG. 4A illustrates one surface of a dielectric substrate with a secondary winding patterned thereon according to the present invention.
Figure 4B:
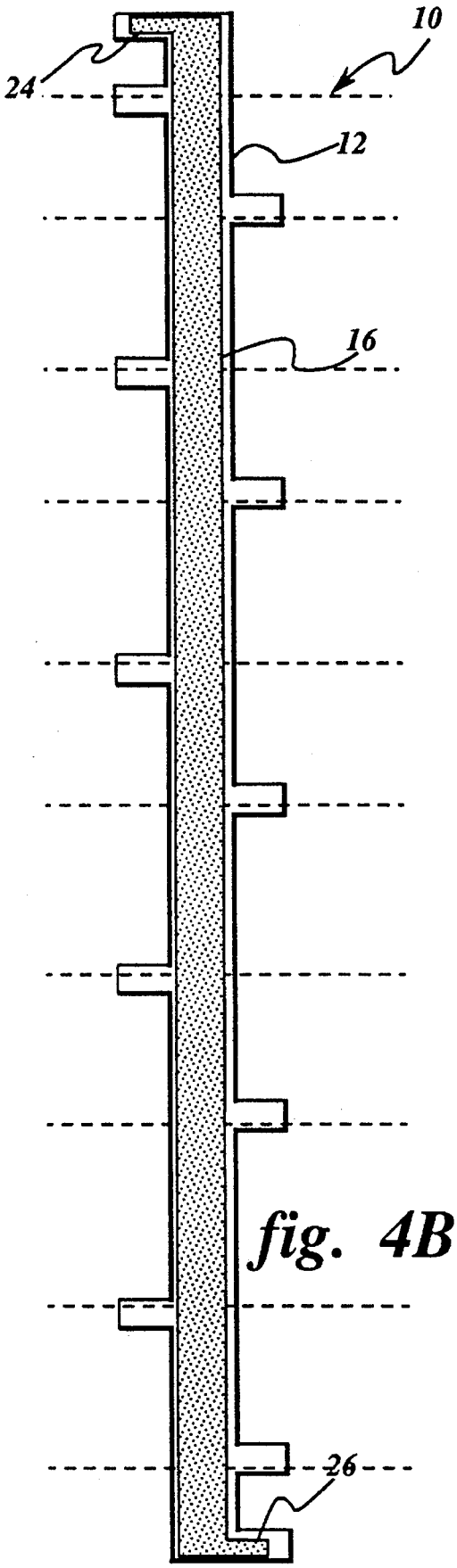
FIG. 4B illustrates the other surface of the dielectric substrate of FIG. 4A with a primary winding patterned thereon according to the present invention.

FIGS. 4A and 4B illustrate an alternative embodiment of a transformer winding configuration according to the present invention wherein secondary terminations 20 are situated on the opposite side of the secondary conductive films as secondary terminations 22. In this way, secondary winding connectors 36 and 38 are situated on opposite ends (i.e., top and bottom) of the transformer after barrel-winding, which is advantageous for some applications. Likewise, primary winding connectors 24 and 26 are situated on opposite ends of the transformer after barrel-winding.

A suitable conductive film comprises copper, and a suitable dielectric substrate comprises a polyimide film such as that sold under the trademark Kapton by E. I. du Pont deNemours and Company. Other suitable conductive films comprise, for example, silver, gold, nickel, platinum or palladium. Other suitable dielectric substrates may comprise the following: a polyester; a polyethylene terpthalate such as that sold under the trademark Mylar® by E. I. du Pont deNemours and Company; a polyetherimide such as that sold under the trademark ULTEM® by General Electric Company; a polyethylene napthalate; a polysulfone; or a silicone.

A suitable method for manufacturing a magnetic circuit element according to the present invention is by etching using photoresist materials as a mask in a well-known manner, for example by an etching method wherein resists are patterned by screen printing.

Advantageously, a transformer constructed in accordance with the principles of the present invention has a very low and controlled leakage inductance. Furthermore, such a transformer exhibits the following characteristics: good high-frequency performance due to the parallel winding faces; a high degree of interleaving and, therefore, reduced magnetic field at the winding surfaces; and very thin windings, reducing the detrimental effects of high-frequency skin effect and proximity effect.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A transformer, comprising an elongate dielectric laminate having two surfaces, a primary winding disposed on and extending substantially the length of said laminate, said primary winding having a pattern conformal to said laminate, said laminate having a secondary winding disposed on the other surface thereof, said laminate comprising corresponding sections on said two surfaces, each section having a length corresponding to the length of a winding turn, said secondary winding comprising at least two patterned conductive films spatially separated on said laminate, each of the conductive films of said secondary winding occupying substantially the length of a section;

a dielectric layer situated adjacent to said laminate;

said laminate, said windings and said dielectric layer comprising a barrel-wound configuration of interleaved winding layers with a dielectric layer between each of said winding layers, said transformer having a predetermined ratio of primary winding turns to secondary winding turns and a predetermined leakage inductance;

said laminate, said windings and said dielectric layer being situated in a magnetic core.

2. The transformer of claim 1, further comprising primary and secondary terminations extending outwardly from the same end of said transformer.

3. The transformer of claim 1, further comprising primary and secondary terminations extending outwardly from opposite ends of said transformer.

4. The transformer of claim 1 wherein said secondary winding turns are connected in parallel to each other.

5. The transformer of claim 1 wherein said magnetic core comprises a cylindrical pot core comprising a top and a bottom and a center core post extending therebetween.

6. The transformer of claim 1 wherein said primary and secondary windings are patterned by etching a primary conductive film and a secondary conductive film, respectively, on the respective opposite surfaces of said laminate.

7. The transformer of claim 1 wherein primary and secondary winding turns which are offset from each other on said laminate by approximately one-half turn, said transformer further comprising primary and secondary terminations extending outwardly at approximately 180° from each other on the same end of said transformer.

8. The transformer of claim 1, further comprising a pair of primary terminations and a pair of secondary winding terminations, one termination of each said pair extending outwardly from each end of said transformer.

* * * * *